US009010896B2

(12) United States Patent
Tomida

(10) Patent No.: US 9,010,896 B2
(45) Date of Patent: Apr. 21, 2015

(54) PRINTING APPARATUS AND METHOD FOR ADJUSTING PRINTING POSITION THEREOF

(75) Inventor: Akihiro Tomida, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 274 days.

(21) Appl. No.: 13/351,392

(22) Filed: Jan. 17, 2012

(65) Prior Publication Data

US 2012/0188301 A1 Jul. 26, 2012

(30) Foreign Application Priority Data

Jan. 26, 2011 (JP) ..... 2011-014313

(51) Int. Cl.
*B41J 29/38* (2006.01)
*B41J 2/21* (2006.01)

(52) U.S. Cl.
CPC ..... *B41J 2/2132* (2013.01)

(58) Field of Classification Search
None
See application file for complete search history.

(56) References Cited

U.S. PATENT DOCUMENTS

| | | | | |
|---|---|---|---|---|
| 7,789,476 | B2 | 9/2010 | Tomida et al. | |
| 7,980,652 | B2 | 7/2011 | Baba et al. | |
| 2002/0135629 | A1 * | 9/2002 | Sarmast et al. | 347/19 |
| 2005/0179710 | A1 * | 8/2005 | Tatsuta et al. | 347/5 |
| 2006/0087529 | A1 * | 4/2006 | Tayuki | 347/19 |
| 2009/0231382 | A1 * | 9/2009 | Mizes et al. | 347/19 |
| 2012/0013664 | A1 | 1/2012 | Komamiya et al. | |

FOREIGN PATENT DOCUMENTS

JP 3554184 B2 5/2004

* cited by examiner

*Primary Examiner* — Geoffrey Mruk
*Assistant Examiner* — Bradley Thies
(74) *Attorney, Agent, or Firm* — Fitzpatrick, Cella, Harper & Scinto

(57) ABSTRACT

The invention provides a printing apparatus which can adjust printing position more accurately. The apparatus has a printing unit, a pattern printing unit to print a first pattern and a second pattern so as to form a third pattern, and an adjustment unit to perform an adjustment regarding position of dots to be printed by the printing unit based on an optical reflectivity of the third pattern. The second pattern is substantially the same as the first pattern and is shifted relative to the first pattern in a predetermined direction. The first and second patterns each include a plurality of patterns having different cyclic natures in the predetermined direction.

11 Claims, 19 Drawing Sheets

PRINTING APPARATUS AND METHOD FOR ADJUSTING PRINTING POSITION THEREOF

BACKGROUND OF THE INVENTION

1. Field of the Invention

The present invention relates to a printing apparatus such as an inkjet printing apparatus and a method for adjusting printing position thereof.

2. Description of the Related Art

Japanese Patent No. 3554184 discloses a printing position adjustment method in an inkjet printing apparatus. More specifically, a "reference pattern" is printed by a reference nozzle array, after which a plurality of "shifted patterns", which are printed from a different nozzle array whose printing position is shifted a little at a time from the reference pattern, are printed over the reference pattern. Then based on the amount that the printing position of the shifted pattern is shifted and the position of the inflection point of the optical reflectivity, the amount of shift in the landing position is calculated and the discharge timing that the printing head discharges ink is corrected.

In the method disclosed in Japanese Patent No. 3554184, in order to achieve a highly-accurate adjustment of the landing position, the calculation error must be reduced by matching the approximation curve and the optical characteristics well. Therefore, it is preferred to calculate an approximate expression from an optical reflectivity that is near the inflection point and within a smaller shift range. However, by using a change of the amount of shift within a smaller range, the change of the optical reflectivity is also smaller. As a result, the effect of a disturbance such as noise cannot be ignored and sufficient accuracy cannot be obtained.

SUMMARY OF THE INVENTION

The present invention provides a printing apparatus to adjust the landing position of ink droplets by inkjet printing more accurately, and a method for adjusting printing position of the apparatus.

The present invention provides a printing apparatus including:

a printing unit configured to print an image by printing dots on a printing medium;

a pattern printing unit configured to cause the printing unit to print a first pattern and a second pattern so as to form a third pattern using the printing unit, the second pattern being substantially the same as the first pattern and being shifted relative to the first pattern in a predetermined direction, and an adjustment unit to perform an adjustment regarding position of dots to be printed by the printing unit based on an optical reflectivity of the third pattern, wherein the first and second patterns each include a plurality of patterns having different cyclic natures in the predetermined direction.

According to the present invention, it is possible to increase the degree of change of an optical reflectivity near an amount of shift in which printing positions of the two patterns overlap, so that it enables to obtain a sufficient change of an optical reflectivity, thereby improving the detection accuracy of the amount of the landing position shift.

Further features of the present invention will become apparent from the following description of exemplary embodiments (with reference to the attached drawings).

DESCRIPTION OF THE EMBODIMENTS

Embodiments of the present invention will be described with reference to the drawings.

Details of registration adjustment processing according to the present embodiment will be described.

(Basic Configuration)

Figure 1:
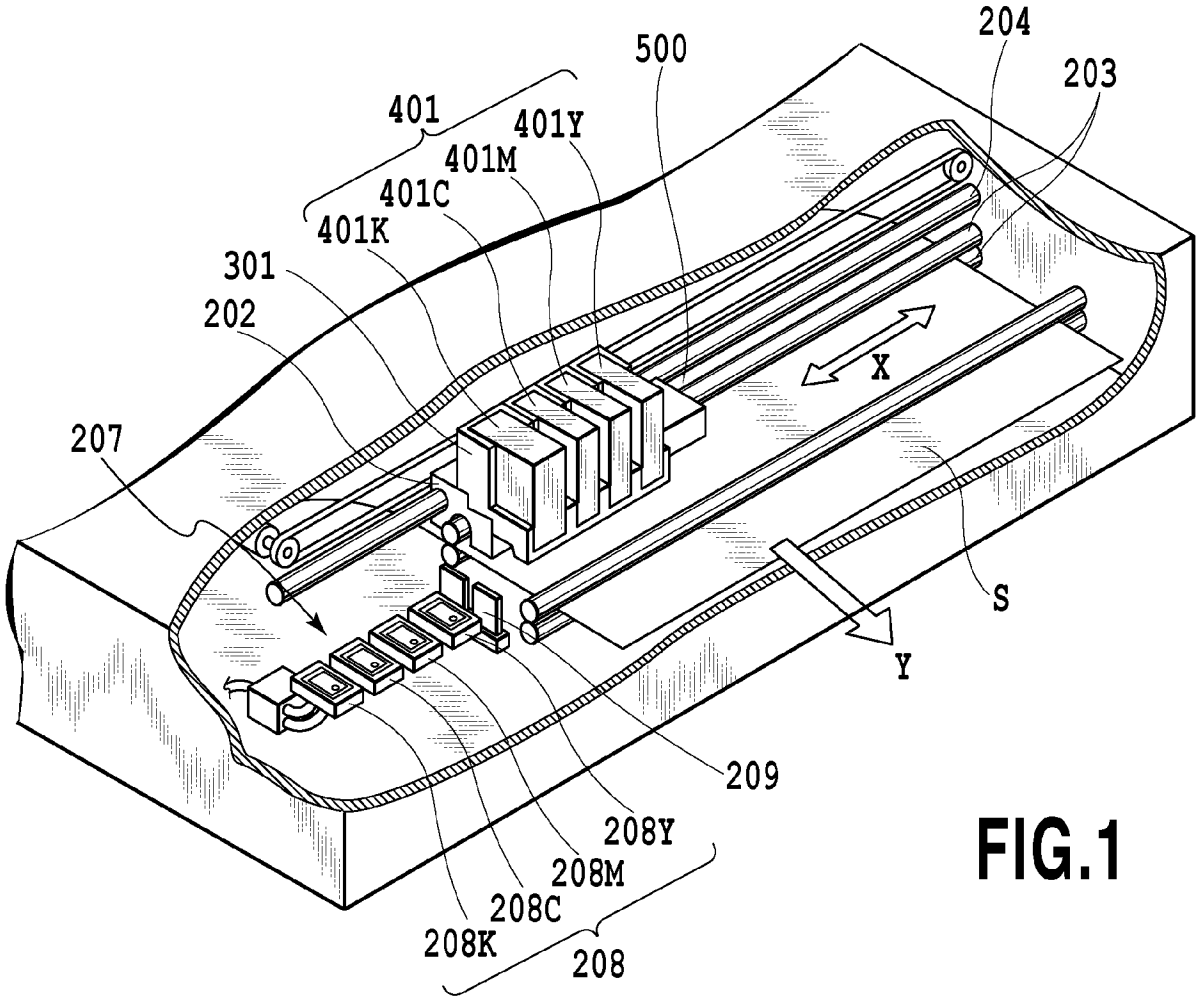
FIG. 1 is a perspective view of one example of an inkjet printing apparatus to which the present invention is applied.
Figure 2:
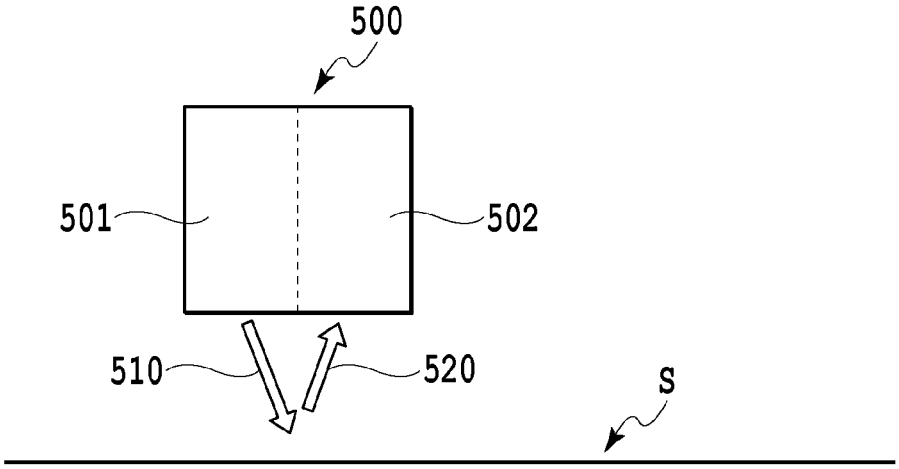
FIG. 2 is a diagram illustrating one example of an optical sensor used for the present invention.
Figure 3:
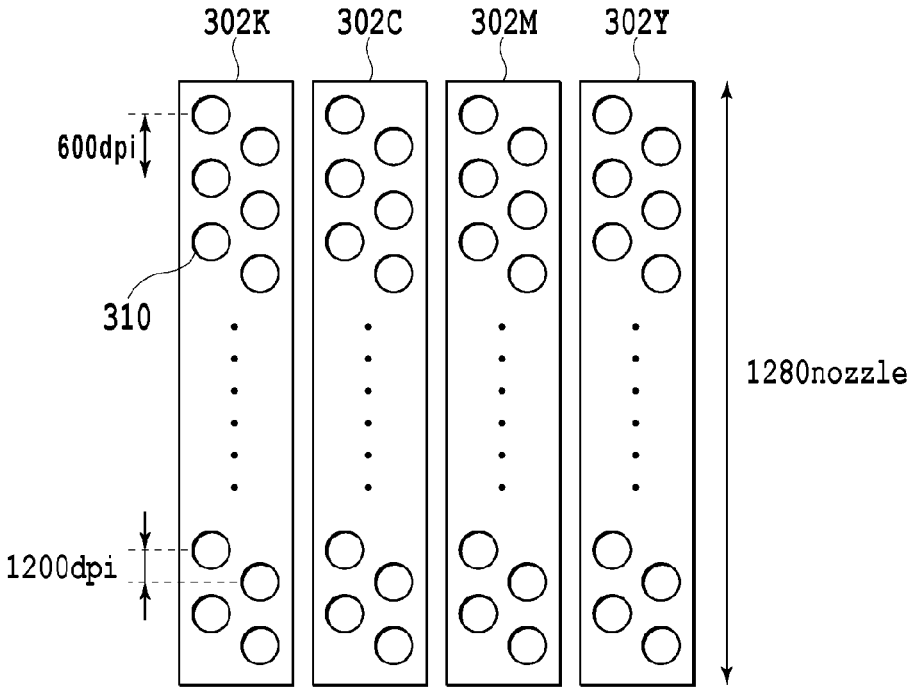
FIG. 3 is a diagram illustrating a nozzle arrangement of a printing head used for the apparatus in FIG. 1.

FIGS. 1 to 3 illustrate an example of a basic configuration of an inkjet printing apparatus (hereinafter simply referred to as a printing apparatus) to which the present invention can be applied.

FIG. 1 is a perspective view schematically illustrating the main configuration of an inkjet printing apparatus according to the present embodiment. In FIG. 1, a printing head 301 reciprocates in a scanning direction indicated by an arrow X, and a printing medium S such as a common printing paper, a special paper and an OHP film is conveyed in a conveying direction (vertical scanning direction) indicated by an arrow Y that intersects with (is orthogonal to, in this example) a scanning direction in every predetermined pitch. While ink is discharged from a discharge port of the printing head 301 based on print data, a scanning operation to make the printing head 301 reciprocate and a conveying operation to convey the printing medium S are repeated thereby to land ink droplets on the printing medium S to print an image including characters and symbols.

The printing head 301 is an inkjet printing unit to utilize thermal energy to discharge ink and is provided with an electro-thermal converter for generating thermal energy. The printing head 301 utilizes a pressure change caused by growth and contraction of air bubbles by the boiling of film that occurs with thermal energy applied by the electro-thermal converter, in order to discharge ink from an ink discharge port (nozzle) and perform printing.

The printing head 301 is mounted to a carriage 202 such that it is removable. The carriage 202 is supported such that it is can freely slide along a guide rail 204, and is moved back and forth along the guide rail 204 by a driving unit such as a motor (not illustrated in the figure). The printing medium S is conveyed by a conveying roller 203 in a conveying direction indicated by the arrow Y such that a fixed facing interval is maintained between the printing medium S and the surface of the discharge ports (surface formed by the ink discharge ports) of the printing head 301.

At the printing head 301, a plurality of nozzle arrays (discharge port arrays) for discharging different inks is formed. In this example, nozzle arrays that can discharge black (K), cyan (C), magenta (M) and yellow (Y) inks are formed. To the printing head 301, ink cartridges 401 (401K, 401C, 401M, 401Y) for supplying ink (black, cyan, magenta, yellow ink) to be discharged from the printing head 301 are mounted such that they can be separately removed.

A recovery unit 207 is provided that faces the surface of the ink discharge ports of the printing head 301 when the printing head 301 moves to the non-printing area, which is an area within the range of back-and-forth movement of the printing head 301, however is outside of the range where the printing medium passes. This recovery unit 207 is provided with caps 208 (208K, 208C, 208M, 208Y) that can cap the discharge ports of the printing head 301. The caps 208K, 208C, 208M, 208Y can cap the respective discharge ports that discharge black, cyan, magenta and yellow ink. A suction pump (a negative pressure generation means) is connected to the inside of the caps 208. When the caps 208 are capping the discharge ports of the printing head 301, it is possible to suck the ink from the discharge ports of the printing head 401 into the caps 208 by applying a negative pressure to the inside of the caps 208. By performing this kind of suction recovery operation, it is possible to maintain the ink discharge performance of the printing head 301.

The recovery unit 207 also comprises a wiper 209 such as a rubber blade for wiping the surface of the discharge ports of the printing head 301. By discharging ink from the printing head 301 toward the caps 208, it is possible to perform a recovery process (also called "reserve discharge") to maintain the ink discharge performance of the printing head 301.

A reflective optical sensor 500 as illustrated in FIG. 2 is provided in the carriage unit 2. There is an LED installed in a light-emitting unit 501, and the light 510 that is emitted by that LED is irradiated onto the printing medium S. The light 520 that is reflected by the printing medium S is incident on the light-receiving unit 502, and converted to an electrical signal by a photo diode.

FIG. 3 illustrates arrays of discharge nozzles 310 disposed on the printing head 301. Nozzle arrays (302K, 302C, 302M, 302Y) that discharge C, M, Y, K ink respectively are disposed in two rows in a conveying direction, and 1280 nozzles are disposed in total. Nozzles are disposed at intervals of 600 dpi in each nozzle array, and the two nozzle arrays are shifted only by 1200 dpi to each other in a conveying direction. This allows for printing at a resolution of 1200 dpi in a conveying direction.

(Printing Position Adjustment Method)

Hereinafter, a printing position adjustment method in the present embodiment will be described.

Figure 4:
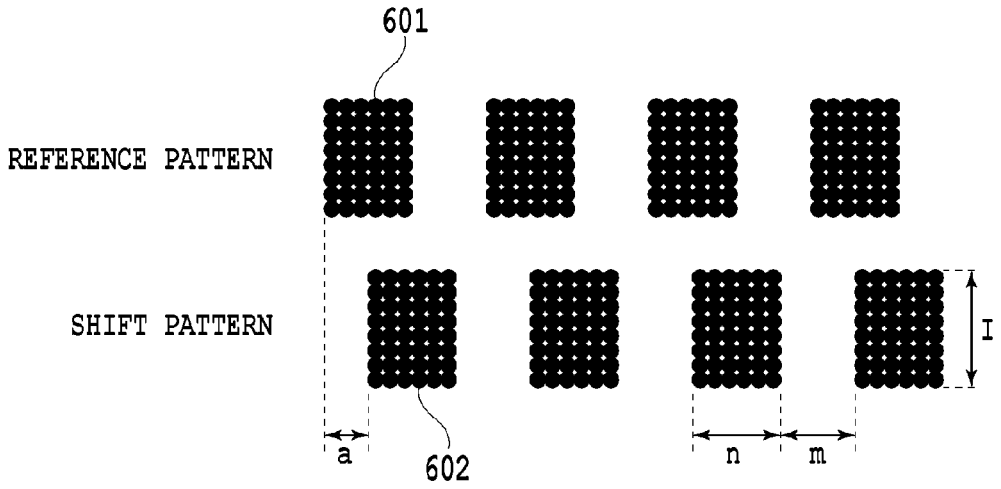
FIG. 4 is a diagram illustrating a configuration of a registration adjustment pattern in the present invention.

FIG. 4 illustrates a configuration of an adjustment pattern used in a printing position adjustment method that decides an adjustment value on the basis of the result of measuring an optical reflectivity, which is an optical reflection characteristic of the adjustment pattern, with the use of the optical sensor 500 mounted on the printing apparatus.

The adjustment pattern illustrated in FIG. 4 has a configuration such that a rectangular shaped dot pattern that is 1 pixel×n pixels is periodically repeated after an empty area of m pixels in a scanning direction. This adjustment pattern (a third pattern) is composed of two patterns, that is, a reference pattern (a first pattern) 601 and a shifted pattern (a second pattern) 602, and the shifted pattern 602 is set such that a printing position thereof is shifted a certain number of pixels 'a' with respect to a printing position of the reference pattern 601 in a scanning direction. That is, with respect to the reference pattern 601 having a repetition cyclic nature, the phase of the shifted pattern 602 having the same repetition cyclic nature as that of the reference pattern 601 is changed. Hereinafter, the changed amount is simply referred to as the amount of shift. Intervals between dots printed in the adjustment pattern and a unit of change of the amount of shift depend on a printing resolution of a printing apparatus. In the present embodiment, a printing resolution of the adjustment pattern is taken to be 1200 dpi.

Figure 5:
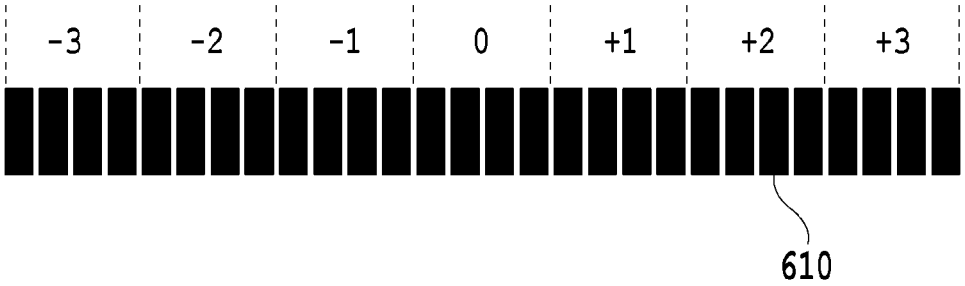
FIG. 5 is a diagram illustrating a registration adjustment pattern printed by changing the amount of shift.

FIG. 5 illustrates a plurality of adjustment patterns in FIG. 4 arranged each having a different amount of shift from −3 pixels to +3 pixels. When a relative amount of shift of printing positions of the two patterns changes, overlapping of dots also changes, thereby changing the area ratio of ink to the printing medium (hereinafter referred to as an area factor). When an area factor increases, a reflectivity of LED light irradiated from the sensor decreases and the optical density increases. Contrary, when an area factor decreases, the reflectivity increases and then optical density decreases.

Figure 6:
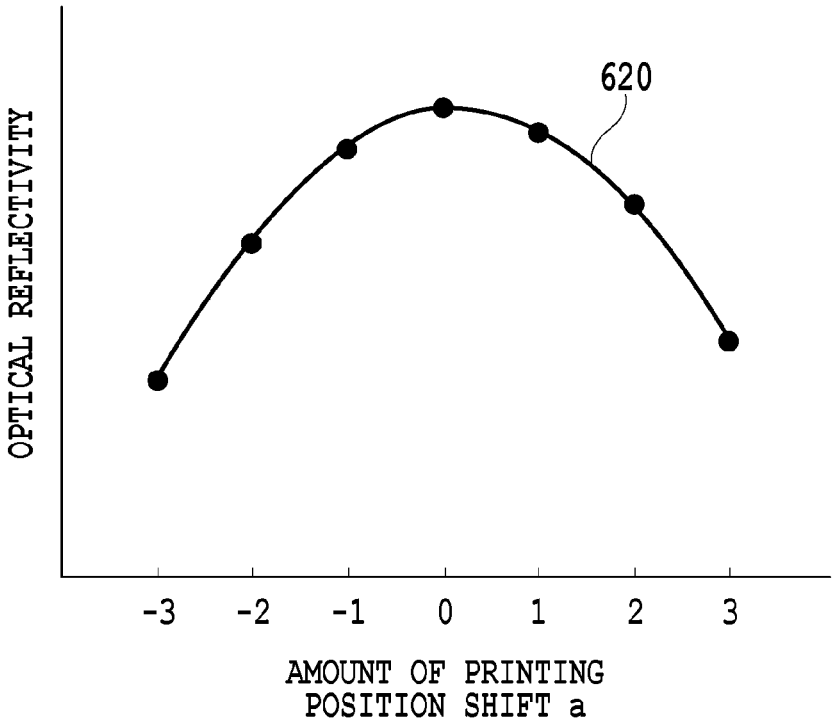
FIG. 6 is a graph representing the optical reflectivity relative to an amount of shift and an approximation curve thereof.

For example, if dots are placed without a landing position shift in a scanning direction when forming a pattern, the relationship of the reflected light intensity with respect to the amount of shift of the pattern is as shown in FIG. 6. Since the reference pattern and the shifted pattern are configured to have the same dot arrangements, the overlapping amount between the two patterns takes a maximum value and the area factor takes a minimum value in a state where the amount of shift is zero in FIG. 5, that is, there is no amount of shift between the two patterns. Therefore, the optical reflectivity becomes maximum value in this position. On the contrary, if the amount of shift between the reference pattern and the shifted pattern increases, the overlapping amount of dots of the reference pattern and the shifted pattern decreases and an area factor increases. As a result, as the amount of shift increases, the optical reflectivity decreases.

If, in printing the shifted pattern, the landing position shift, which is a shift different from the original shift that is achieved by previously shifting the shifted pattern with respect to the time of the reference pattern printing, occurs in a scanning direction, the area factor changes according to the amount of landing position shift and therefore the amount of shift to realize a maximum reflectivity also changes. At this time the amount of shift to realize a maximum reflectivity is the same as the amount of landing position shift.

From the above, by detecting the inflection point where the reflectivity is the maximum of a plurality of patterns printed with different amounts of shift, it is possible to detect the amount of printing position shift of the shifted pattern with respect to the reference pattern from the amount of shift in this state.

Figure 7:
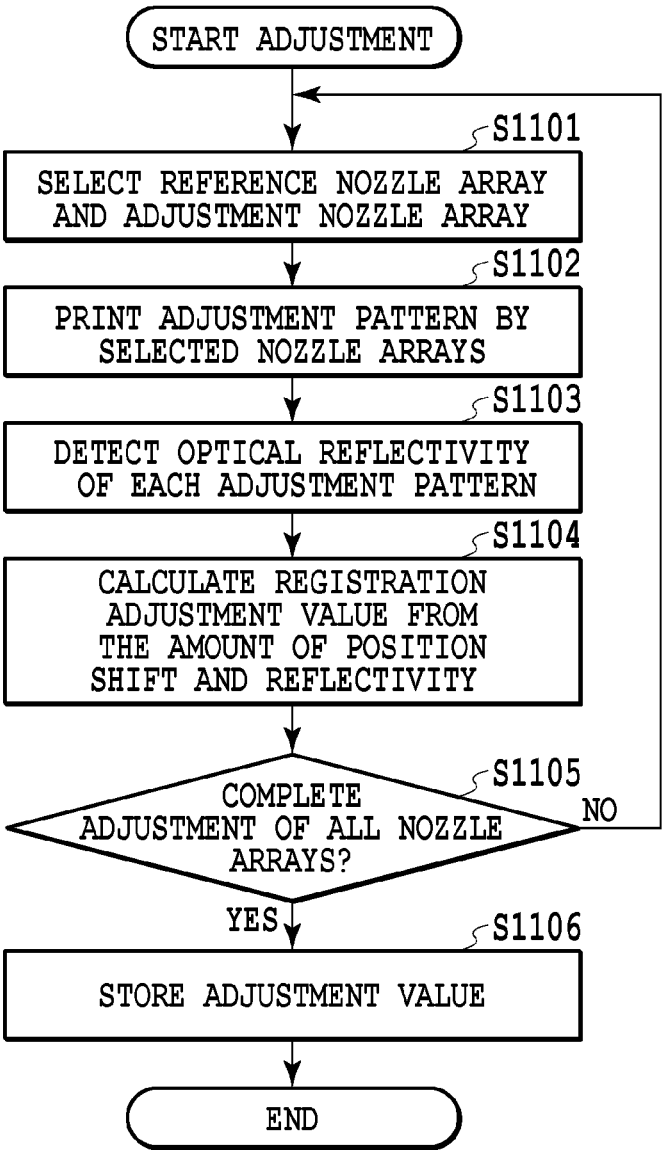
FIG. 7 is a flow chart illustrating the flow of a registration adjustment method according to the present invention.

FIG. 7 is a flow chart illustrating procedures to calculate a printing position adjustment value from the above adjustment pattern. As illustrated in FIG. 4, at Step S1101, a reference nozzle array is used to print the reference pattern 601 on a printing medium, and at Step S1102 a nozzle array for adjustment is used to print the shifted pattern 602. In adjusting a printing position in both directions, one nozzle array is selected to print the reference pattern 601 in an outgoing path or a returning path and to print the shifted pattern 602 in the other path. After that, at Step S1103, the optical sensor is used to obtain an optical reflectivity of the adjustment pattern 610. The result read by the optical sensor is obtained as an optical reflectivity with respect to the amount of shift 'a', as illustrated in FIG. 6, and an approximation curve 620 is calculated from change in the neighborhood of maximum reflectivity. At Step S1104, based on the approximation curve, the amount of shift 'a' is decided in which the position shift takes a minimum value between the reference pattern and the shifted pattern thereby to calculate a printing position adjustment value (a registration adjustment value). Here, the registration adjustment resolution is 4800 dpi, and the registration adjustment value is calculated at the unit of 4800 dpi. Toward the plus sign, discharge timing is shifted to an outgoing direction, and toward the minus sign, the discharge timing is shifted to a returning direction.

In this way, the procedures are repeated at Step S1105 until a registration adjustment value for the respective nozzle arrays is calculated, and the obtained registration adjustment values are stored in a storage region of the printing apparatus at Step S1106.

(Optical Characteristic of Pattern)

First, a method for deciding the dot arrangement of the adjustment patterns used in the present invention will be described.

Figure 8:
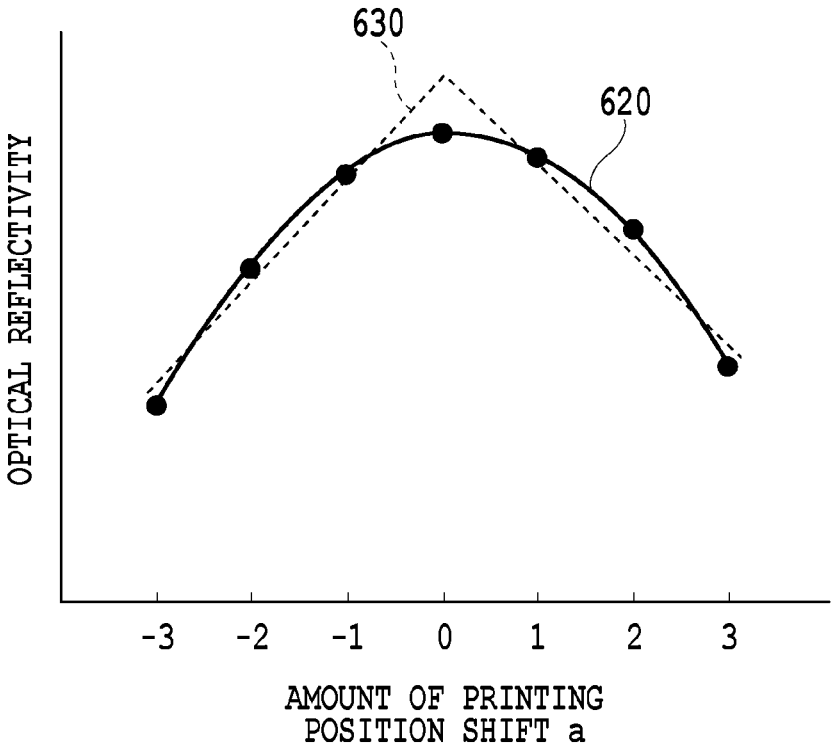
FIG. 8 is a graph comparing the optical reflectivity with respect to an amount of shift with the result of straight-line approximation thereof.
Figure 9:
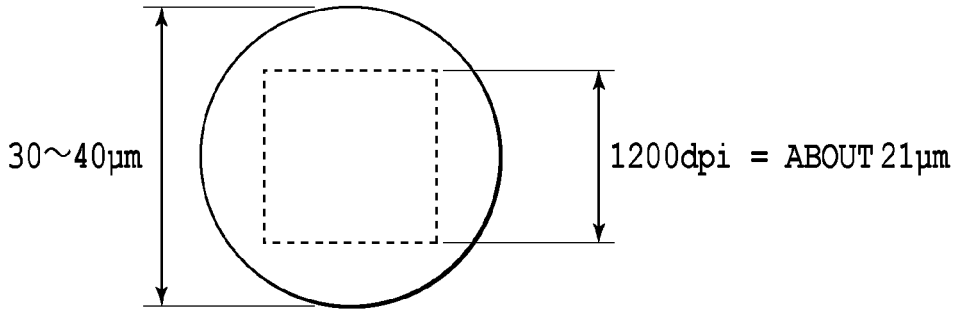
FIG. 9 is a diagram comparing a printing pixel with a size of a dot.

The optical reflectivity of the adjustment pattern correlates with the area factor, as described above. However, the area factor and optical reflectivity do not have a proportional relation. In the configuration of the adjustment pattern in FIG. 5, the optical reflectivity with respect to the amount of shift in FIG. 6 is approximated based on the change of the area factor, resulting in the dot line 630 in FIG. 8. Since an area factor is simply defined by an area occupied by ink, the area factor primarily changes relative to the amount of shift. Meanwhile, as the change of the optical reflectivity detected by the sensor approaches a position of maximum value, the change becomes gradual. At this point, the area factor and optical reflectivity have different characteristics, and therefore do not match by a first-order approximation.

The factor is considered to be optical dot gain. Optical dot gain is a phenomenon in which when light incident to a printing medium is scattered by a surface and inside of the printing medium and goes out of the printing medium, the light transmits through a dot section or is reflected by the dot section, thereby reducing the intensity of light going out of a white section, so that the intensity of the white section appears to be increased. The range of the effect of optical dot gain and the magnitude of a density increase vary depending on a printing medium, a wavelength characteristic of the incident light, an ink property and so on, which are not simply proportional to the area factor and the degree of effect varies depending on a factor such as the interval between dots. Therefore, optical dot gain is considered to cause an optical reflectivity relative to the amount of pattern shift behaving nonlinearly.

From the above, when the amount of the landing position shift between the reference pattern and the shifted pattern is changed, the optical reflectivity is considered to become a nonlinear curve, which is difficult to be represented by a simple model. However, if the cyclical pattern in which a dot region and a blank region are repeated as illustrated in FIG. 4 overlap each other, an optical reflectivity relative to the amount of shift can approach a relatively simple curve.

Figure 10:
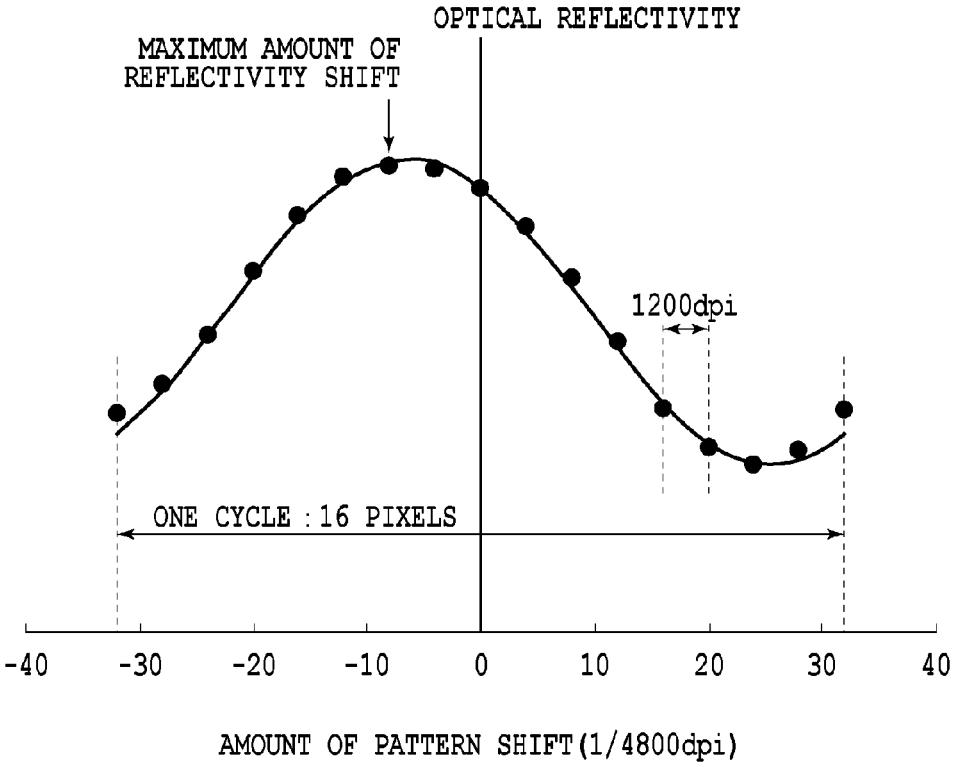
FIG. 10 is a graph representing an optical reflectivity and an approximation curve thereof by a trigonometric function.

For example, FIG. 10 illustrates change of an optical reflectivity relative to the amount of printing position shift of the shifted pattern in the adjustment pattern configuration illustrated in FIG. 6 when the printing resolution is 1200 dpi and n=m=8. Black circles in the graph of FIG. 10 are reflectivity values actually measured and the solid line is a curve obtained by approximating the measured values by a trigonometric function. This adjustment pattern has a configuration in which the dot section and the blank section are repeated alternately every eight pixels. Every time the amount of shift of the shifted pattern changes by 16 pixels, an overlapping state of the shifted pattern becomes identical to that of the reference pattern. In the neighborhood of the amount of shift in which the overlapping amount of the patterns are maximum or minimum, since in addition to the change of the area factor, the effect of optical dot gain increases as described above, change of the optical reflectivity becomes gradual. This causes change of the optical reflectivity relative to the amount of shift of the pattern to behave similarly to a trigonometric function, as illustrated in FIG. 10. Naturally, in the case where an adjustment pattern where the ratio of a dot region and the ratio of a blank region are not the same is used, since there is a region in which an area factor does not change relative to change in the amount of shift, change of the optical reflectivity relative to the amount of shift cannot be represented by a simple function as in this example. If the blank region is too small, the contribution of dot gain becomes too large, as a result, and change of the optical reflectivity relative to the amount of shift of the pattern virtually behaves in the same manner as a pattern with a larger dot ratio. In such a case, considering reduction of the optical reflectivity by dot gain, change of the optical reflectivity relative to the amount of shift of the pattern can behave in a trigonometric functional manner by reducing the dot ratio.

Hereinafter, with the use of a pattern having a cyclic-functional optical characteristic as described above, a method to configure a pattern in which change of an optical characteristic is large in the neighborhood of a position of overlapping of a reference pattern and a shift pattern will be described.

As described above, a pattern in which the pixel ratio between dots and blank, including an effect of dot gain, is close to 1:1 exhibits an optical characteristic close to a simple trigonometric function. When an optical reflectivity of the adjustment pattern is actually measured to derive an amount of landing position shift, the reflectivity of LED light from a sensor is used and a reflected light intensity will be represented as follows.

$$I(x)=I_0-I\times\cos\{2\pi(x-x_0)/k\} \quad \text{(Expression 1)}$$

$I_0$: Maximum reflectivity of adjustment pattern

I: Amplitude of reflected light intensity relative to the amount of shift x: Amount of printing position shift by input image $x_0$: Amount of landing position shift k: Repetition cycle of pattern If there is a plurality of patterns that have an optical characteristic represented by the above expression and have different repetition cycles, since an optical reflectivity depends on all patterns included in a region where a reflected light is received by a sensor, the optical reflectivity is overlapping of waveforms where amplitudes are different according to the area occupied by the respective patterns, which will be represented by the following expression.

$$I(x)=I_0-\Sigma[Im\times\cos\{2\pi(x-x_0)/km\}] \quad \text{(Expression 2)}$$

A suffix m shows each of the included patterns having different cycles. Im depends on the area ratio of each cyclic pattern.

From this expression, Im can be represented as Fourier series as follows:

$$Im=2/T\times\int_{-T/2}^{T/2}I(x)\cos\{2\pi(x-x_0)/km\}dx \quad \text{(Expression 3)}$$

T is an amount representing a repetition cycle of an optical characteristic I(x) of the adjustment pattern. However, actually, an optical characteristic can be obtained only within a region where the adjustment pattern is printed changing the amount of shift. That is, outside the region where the amount of printing position shift is changing, Expression 3 does not need to be satisfied. In the case of a plurality of cyclic patterns, a repetition cycle of an optical characteristic is the least common multiple of cycles of the respective patterns included. Considering this, in some combinations of selected cycles km, a repetition cycle T can be very long, compared with a single cycle pattern. Therefore, T is set as the maximum range of the amount of landing position shift to be detected, and a coefficient Im is decided so as to reproduce an optical characteristic I(x) within the range.

From the above, in order to obtain an adjustment pattern having a certain optical characteristic I(x), patterns that have a repetition cycle km and different cyclic natures are combined at the ratio of Im so as to be close to a relationship represented by the above Expression 3.

Embodiment 1

In a printing position adjustment method according to the present embodiment, the amount of landing position shift is calculated with the use of an adjustment pattern configured such that a plurality of cyclic patterns is arranged in a conveying direction, each of the cyclic patterns having dots and blank repeated every fixed region in a scanning direction and having a different cycle. In such a plurality of patterns having cyclic nature, by optimizing the cyclic nature and a combination ratio of the patterns, the change amount of the optical reflectivity can be increased in the neighborhood of the amount of shift in which the amounts of landing position shift of two patterns to be detected are the same. As a result, variations of detected values, which are caused by noise occurring during sensor detection and landing variations of ink droplets, can be reduced. In addition, by using a plurality of cyclic patterns, the repetition cycle of the optical characteristic becomes longer, broadening the range of the amount of shift in which the amount of landing position shift can be uniquely detected.

Hereinafter, the most effective setting of a cyclic nature and combination ratio of an adjustment pattern to detect the amount of landing position shift more accurately in this method will be described.

First, an ideal curve of an optical reflectivity relative to the amount of shift obtained by combining a plurality of cyclic patterns will be studied. This can decide the shape of I(x) of Expression 3.

Figure 11:
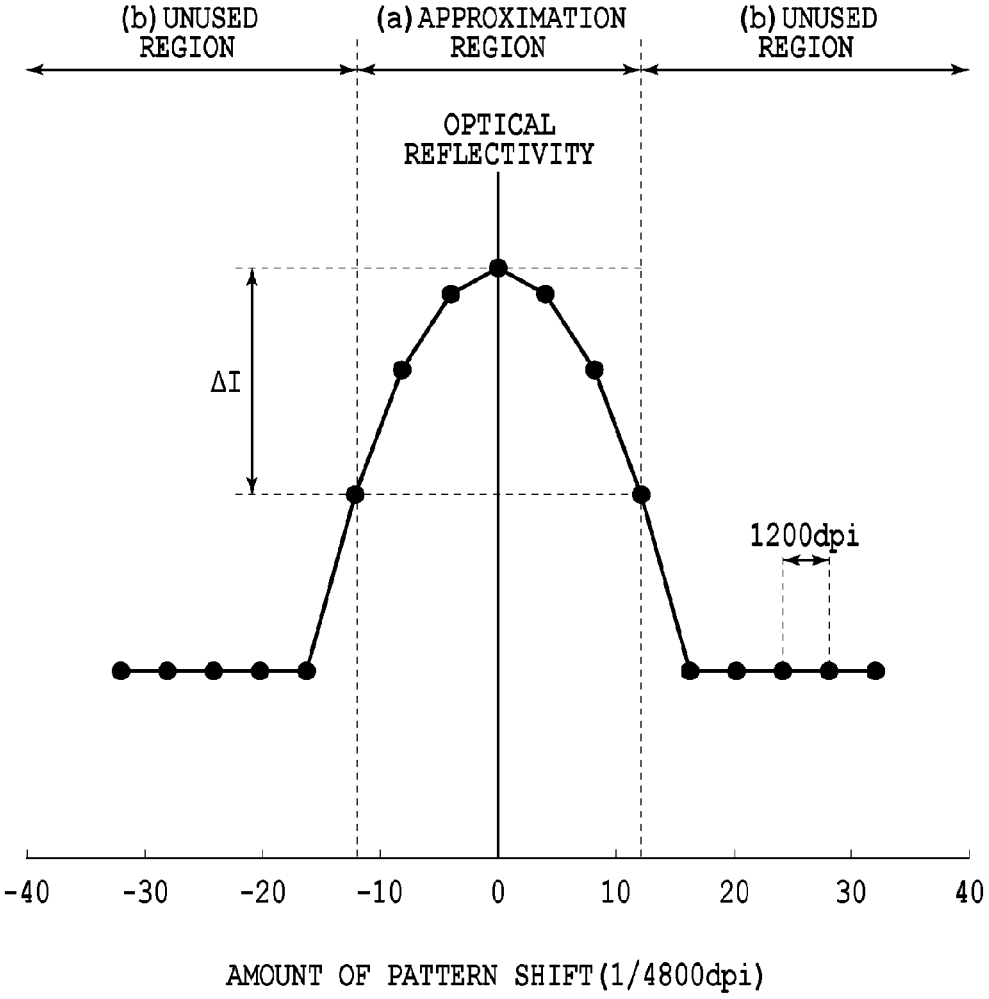
FIG. 11 is a graph illustrating an ideal optical characteristic according to the present invention.

An ideal optical characteristic in the method for adjusting a printing position according to the present invention is illustrated in the graph of FIG. 11. Black circles in FIG. 11 show optical reflectivity values of the adjustment pattern, each of the optical reflectivity values being obtained by changing the amount of shift by 1200 dpi. In FIG. 11, the range of measured points used for calculating the inflection point to realize the maximum optical reflectivity is illustrated as (a) an approximation region, and the region other than the approximation region is illustrated as (b) an unused region.

In the adjustment pattern according to the present embodiment, in the neighborhood of the amount of shift exhibiting a maximum reflectivity, approximation can be performed by a quadratic function from the relationship of the optical reflectivity relative to the amount of shift represented by Expression 2. In the case where approximation is performed by a quadratic function, if there are at least three points, an approximation curve can be decided. However, in order to eliminate an effect such as noise and improve reliability of the approximation curve, it is desirable to perform approximation using more measured results within a range where the approximate expression and the optical characteristic match well. In FIG. 11, seven points are set as (a) an approximation region. Also, suppose that the optical characteristic changes in a quadratic function manner within the region.

An ideal optical characteristic is also specified for (b) an unused region. In the unused region, the optical reflectivity in the unused region should be much lower than a maximum point, from the viewpoint of preventing an erroneous determination. Here, as an ideal condition, a reflectivity in the unused region is set to be a fixed reflectivity lower than that of the approximation region, as illustrated in FIG. 11.

The pattern is configured so that the shape of the optical characteristic that fulfills the above conditions is maintained and change ΔI of the optical reflectivity within the approximation region is greater.

Next, a range that reproduces an ideal curve will be studied. This will decide T of Expression 3.

Figure 12:
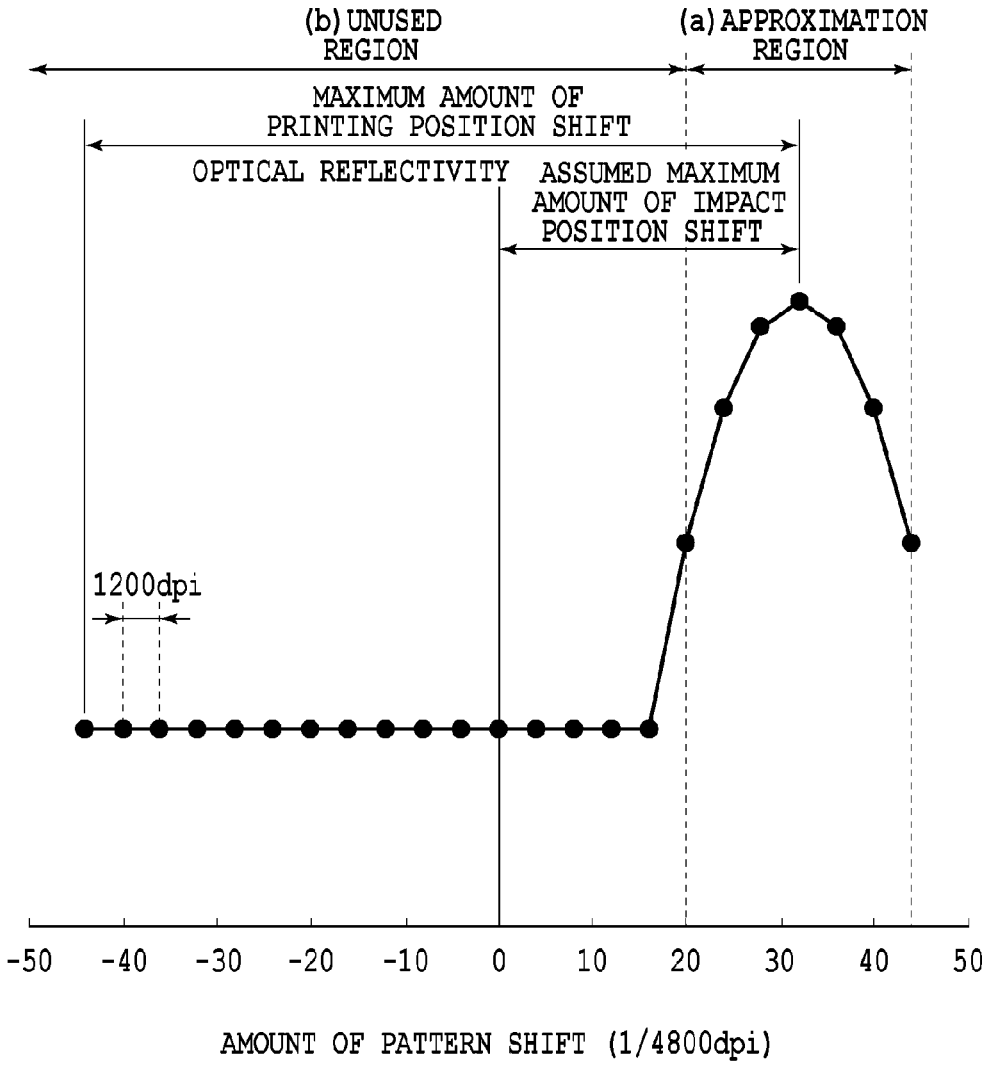
FIG. 12 is a graph illustrating a maximum amount of printing position shift according to the present invention.

T of Expression 3 depends on the magnitude of the amount of landing position shift to be detected, as described above. A maximum amount of landing position shift between two nozzle arrays or between outgoing and returning scans can be assumed from a mechanical landing position shift tolerance of nozzle arrays, a difference of speeds among ink droplets and so on. FIG. 12 illustrates an optical reflectivity distribution of an adjustment pattern having an ideal optical characteristic as illustrated in FIG. 11 when there is a maximum landing position shift. If the maximum amount of landing position shift is 32/4800 dpi=8 pixels, the result measured as an approximation region is necessary to obtain a range of the amount of shift in the neighborhood of the maximum amount of landing position shift. Therefore, if approximation is performed using seven points, adjustment patterns must be printed by changing up to a 12-pixel shift and an optical characteristic thereof must be measured. At this time, if a landing position shift can similarly occur in an opposite direction, the patterns are printed by changing up to a ±12-pixel shift to detect a maximum landing position shift amount. Then, when there is a maximum landing position shift and a maximum optical reflectivity is obtained at a +8-pixel shift, the amount of printing position shift of the pattern at this amount of shift becomes zero, and at −12-pixel shift pattern that is shifted most to the opposite side, the amount of printing position shift is −20 pixels.

From the above, the maximum amount of printing position shift between the reference pattern and the shifted pattern is ±20 pixels, and a magnitude of T is set so as not to make the optical reflectivity to be a maximum point again within this range. By setting T in this way, within the range of an assumed amount of landing position shift, Im and km can be selected so that the amount of landing position shift can be uniquely decided from the optical characteristic relative to the amount of shift of the adjustment pattern.

By the above method, the shape of I(x) and the value of T in Expression 3 can be decided. Then, by calculating a magnitude of Im relative to the cycle km of the adjustment pattern and finding a ratio thereof every cycle km, optimal cycles and a combination ratio of patterns are obtained.

Figure 13A:
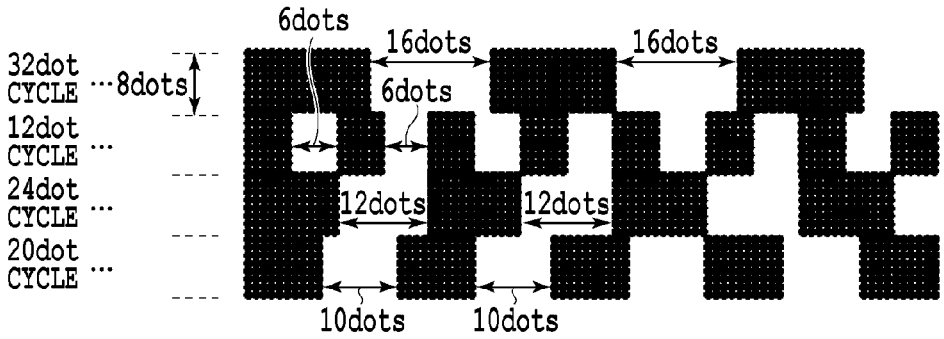
FIGS. 13A to 13D are diagrams illustrating an adjustment pattern composed of a plurality of cyclic patterns according to Embodiment 1.

As one example of an adjustment pattern configuration fulfilling the above conditions, FIG. 13A illustrates a pattern 1 as an example of an adjustment pattern composed of four cyclic patterns: 12 dot, 20 dot, 24 dot and 32 dot cycle patterns. The dot ratio of each of the patterns is set at 50%. Here, the area ratio of each pattern is the same and the patterns are arranged in eight pixels for each pattern in a conveying direction and a combination of the patterns is repeated. FIG. 13A shows a state where landing position of the reference pattern is coincident to landing position of the non reference pattern.

Figure 13B:
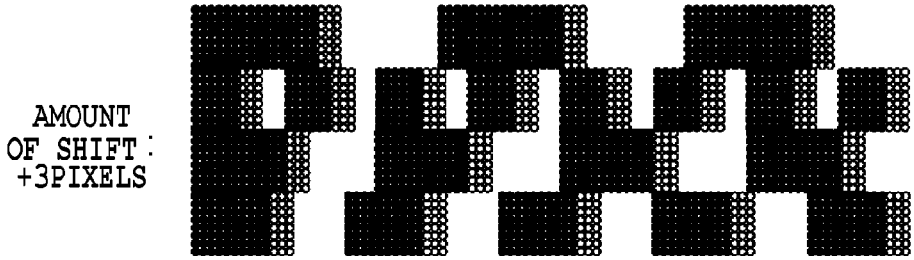
Figure 13C:
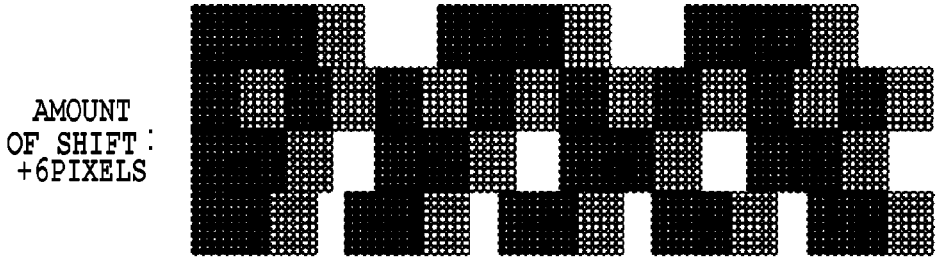
Figure 13D:
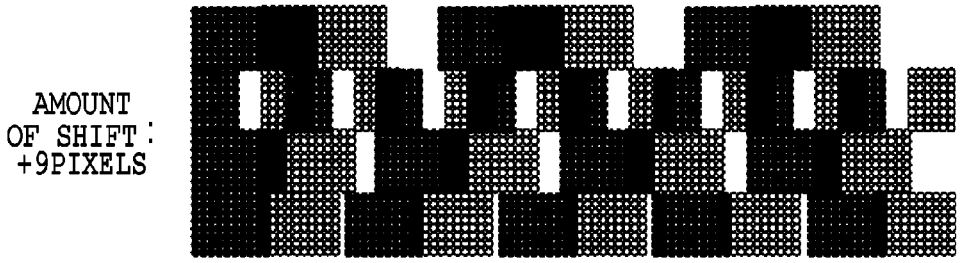

FIGS. 13B, 13C and 13D also illustrate states of overlapping of dots when a shift pattern is shifted relative to a reference pattern by +3, +6, or +9 pixels and printed. In the adjustment pattern illustrated in FIG. 13, as the amount of shift is gradually increased, the area factor increases and the optical reflectivity decreases in each cycle pattern. In the 12 dot cycle pattern having the shortest cycle, the blank region rapidly decreases, and when the pattern is shifted by six pixels, the area factor of the pattern is the largest. By further increasing the amount of shift, the blank region appears again in the 12 dot cycle pattern and the area factor thereof starts to decrease, but in patterns of other cycles the area factor increases.

Figure 14:
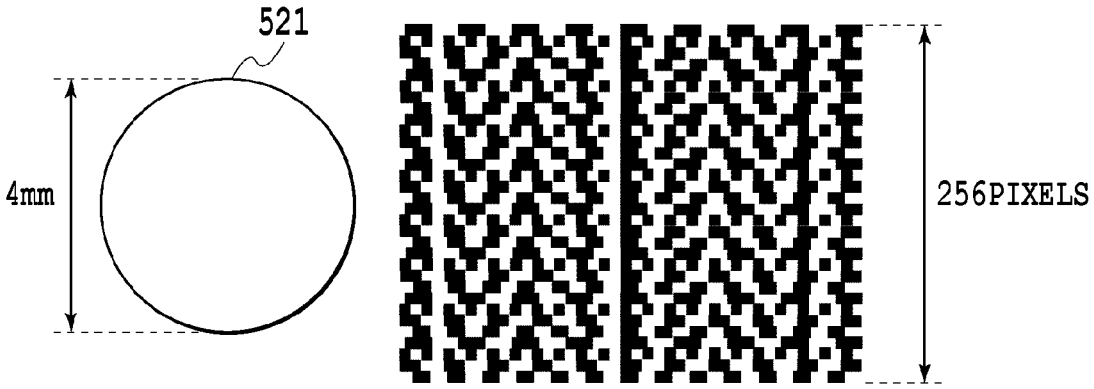
FIG. 14 is a diagram comparing an adjustment pattern according to Embodiment 2 with a light-receiving region of an optical sensor.

The reflectivity is changing relative to the amount of shift for each cycle in this way. It should be noted that the measured reflectivity is decided by the summation of light incident to the light-receiving element (a measurement apparatus) of the optical sensor. As illustrated in FIG. 14, if the size of the light-receiving region (a measurement region) 521 of the sensor has a diameter of 4 mm, the region is sufficiently larger than the repetition cycle of the cyclic pattern in a conveying direction, that is, 8 pixels×4 pixels=32 pixels. That is, the light-receiving region 521, i.e., the measurement region, includes at least one cycle of each of a plurality of patterns having different repetition cyclic natures. Therefore, light from the LED irradiates equally four types of cyclic patterns, and the total reflectivity is deemed to be an average value of the respective cyclic patterns. However, if the repetition cycle of the cyclic pattern in a conveying direction is longer than the size of the light-receiving region, the contribution ratio of each cyclic pattern varies depending on the position of the light-receiving region. Therefore, the repetition cycle of the cyclic pattern in a conveying direction is set to be shorter than the light-receiving region.

Figure 15:
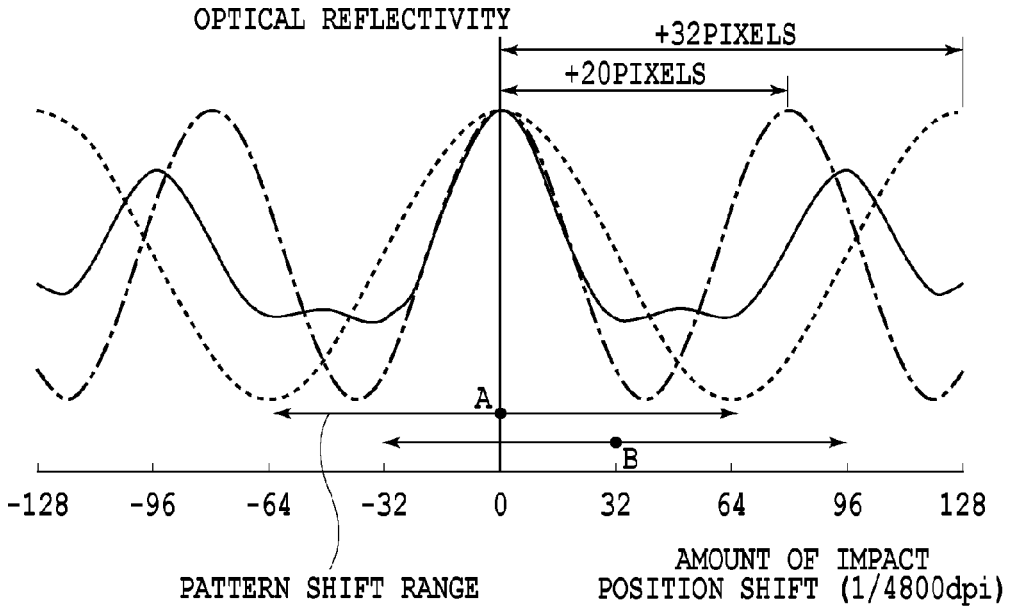
FIG. 15 is a graph comparing the periodicity of an optical characteristic between the adjustment pattern according to Embodiment 1 and a single cycle pattern.

The optical reflectivity measured by a sensor relative to the amount of shift of the adjustment pattern in FIG. 13 is a curve represented by a solid line in FIG. 15. As an example of a conventional adjustment pattern, the dot line in FIG. 15 represents an optical characteristic in the case of the 32 dot single cycle pattern and the chain line in FIG. 15 represents the optical characteristic in the case of the 20 dot single cycle pattern. It should be noted that the horizontal axis in the graph of FIG. 15 is the amount of landing position shift between the reference pattern and the shift pattern, not the amount of shift of the pattern. The adjustment pattern in FIG. 13 is a pattern in which the optical characteristic makes one circuit in the least common multiple 480 pixels of 12, 20, 24 and 32 pixels. During one of the circuit, the reference pattern and the shift pattern completely match each other at only one point. Therefore, in both of the range A to obtain an optical reflectivity distribution of the pattern that is printed by applying the amount of shift when there is no landing position shift and a range B to obtain an optical reflectivity distribution when a maximum amount of landing position shift is eight pixels, the reflectivity becomes maximum at one point where the amount of landing position shift is zero. That is, an adjustment value can be uniquely obtained in spite of the amount of landing position shift before registration adjustment.

This will be compared with the 20 dot cycle pattern represented by the chain line. Since the 20 dot cycle pattern has a short repetition cycle, change of the reflectivity is similar to that of the pattern in FIG. 13 in the neighborhood of a point where the amount of landing position shift is zero. However, since, in the range B, a range to which the amount of shift of the adjustment pattern is applied is longer than the repetition cycle of the pattern, two points where the amount of shift is zero and +20 pixels can have a maximum reflectivity. Therefore, the wrong position, which shifts by one cycle from the position where printing positions of two adjustment patterns match each other, can be detected as the amount of landing position shift.

Figure 16:
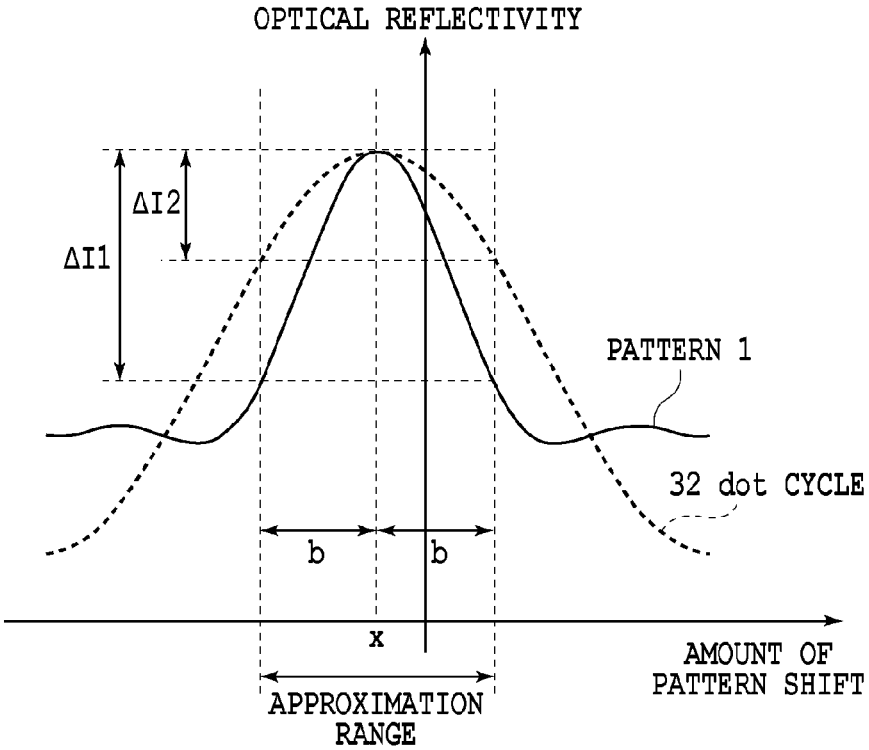
FIG. 16 is a graph comparing an optical characteristic in the neighborhood of a maximum point between the adjustment pattern according to Embodiment 1 and a single cycle pattern.

In the 32 dot cycle pattern that is represented by the dot line and has a longer repetition cycle, only one point has a maximum reflectivity in the range B, but change of the reflectivity becomes gradual. At first glance, amplitude of the reflectivity of the 32 dot cycle pattern appears to be larger than that of the pattern in FIG. 13, but actually is not larger within an approximation range. FIG. 16 illustrates the pattern of FIG. 13 by a solid line and the 32 dot pattern by a dot line for comparison. Here, suppose that there the amount of landing position shift is x, and when the amount of pattern shift becomes −x, there is no printing position shift between the two patterns, thus achieving a maximum reflectivity. Suppose that ±b in the neighborhood of the point to realize a maximum reflectivity is set to be an approximation range. Then, change of the optical reflectivity within the approximation range is ΔI1 in the pattern of FIG. 13 and ΔI2 in the 32 dot pattern, and the former pattern has a greater reflectivity change. After all, in spite of the magnitude of change of the reflectivity outside the approximation range, as the magnitude of change of a reflectivity within the approximation range becomes greater, the effect of disturbance such as noise becomes less, thereby improving detection accuracy.

In this way, in a single cycle pattern, it is difficult to have a sufficient magnitude of change of a reflectivity in the neighborhood of a maximum reflectivity and have a suitable repetition cycle.

Meanwhile, since the adjustment pattern according to the present embodiment is composed of a plurality of patterns each having a different cyclic nature, a cycle having a maximum reflectivity can be broadened, and also a magnitude of change of a reflectivity in the neighborhood of the maximum reflectivity can be increased.

In particular, as described above, by suitably combining a plurality of cyclic patterns on the basis of Expression 3 so as to approach an ideal optical characteristic, change of an optical reflectivity in the neighborhood of an inflection point of the optical reflectivity can be increased, thereby allowing for an accurate calculation of the amount of landing position shift. In addition, even if there is a large landing position shift, a position where patterns match can be uniquely detected by applying the amount of shift to a wide range.

In the adjustment pattern according to the present embodiment, the cycle of the reference pattern and cycles of shift patterns are all different. However, some of the patterns can have the same cycle. In other words, the adjustment pattern according to the present embodiment can include a plurality of reference pattern and shift patterns having different cyclic natures.

Embodiment 2

The present embodiment has the same configuration of that of the adjustment pattern in Embodiment 1. In the present embodiment, in order not to reduce change of the optical reflectivity in the neighborhood of the point where printing positions of the reference pattern and the shift pattern match, the ratio of the dot region relative to the blank region is reduced in a relatively short cycle pattern. That is, in the case where the optical reflectivity of the relatively short cycle pattern decreases due to the effect of dot gain, the dot ratio of this pattern is reduced. This allows for the same advantageous effect as that of Embodiment 1 even under printing conditions in which dot gain increases due to printing medium, ink and so on.

As described above, the optical reflectivity of the adjustment pattern is significantly affected by the physical dot gain and optical dot gain. In the adjustment pattern according to the present embodiment, since degrees of effects of both phenomena increase as the border section between the dot region and the blank region increases, the contribution ratio of dot gain varies depending on the repetition cycle of the dot region and blank region. In addition, contribution of physical dot gain varies depending on the relationship between the printing resolution and the diameter of the dot, and contribution of optical dot gain varies depending on the magnitude of inside scattering of the printing medium and the wavelength characteristic of the illuminating LED light. Therefore, taking effects of physical and optical dot gain into consideration, dot ratios of a plurality of cyclic patterns composing an adjustment pattern need to be decided.

Figure 17:
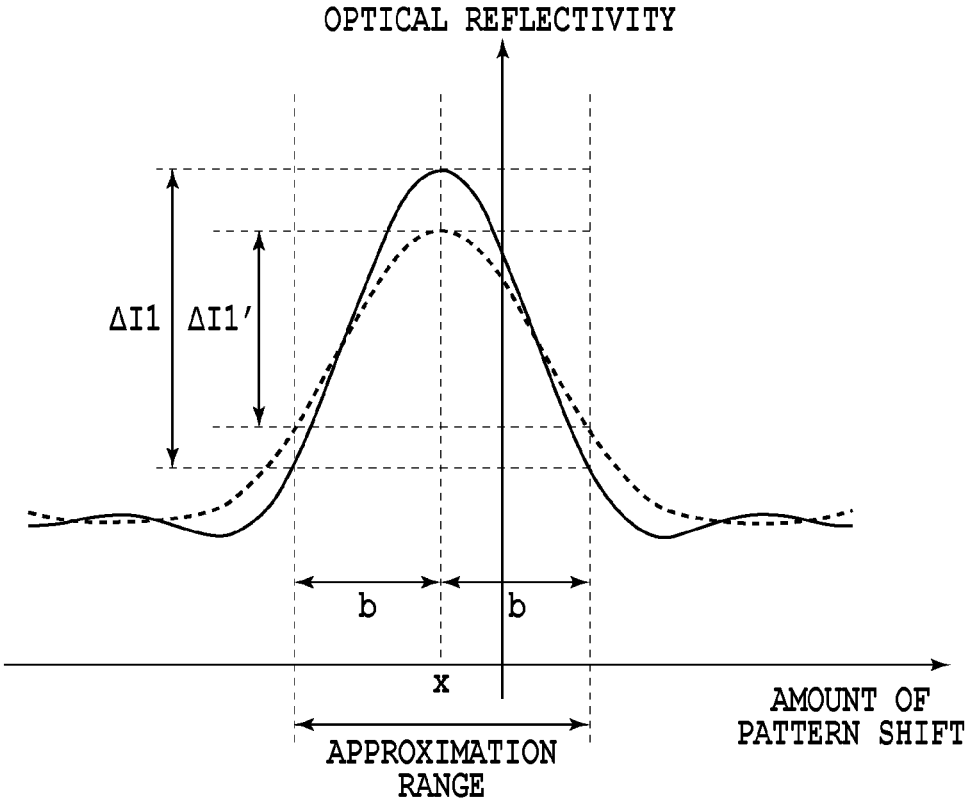
FIG. 17 is a graph illustrating change of an optical characteristic caused by dot gain according to Embodiment 2.

FIG. 17 is a graph comparing changes of an optical reflectivity in the neighborhood of a maximum point due to dot gain. A solid line represents the optical characteristic with little effect of dot gain of the adjustment pattern illustrated in FIG. 13, and a dot line represents the optical characteristic with a great effect of dot gain of the adjustment pattern illustrated in FIG. 13. As the effect of dot gain increases, the reflectivity decreases in a state where the reference pattern and the shift pattern overlap and are printed leaving a white section. Therefore, the maximum reflectivity also decreases. Meanwhile, in a state where the reference pattern and the shift pattern together fill a blank region, the effect of dot gain is smaller than that of a state having a blank region. As a result, relative to the reduction amount of the maximum reflectivity value, the reduction amount of a minimum reflectivity value is smaller, and therefore change of the reflectivity decreases from $\Delta I1$ to $\Delta I1'$. In addition, the curve shape of the optical characteristic becomes irregular and does not behave in a trigonometric functional manner, which does not fulfill the premise and therefore it becomes difficult to reproduce an ideal optical characteristic based on the above Expression 2.

Such a phenomenon can be prevented by reducing the dot ratio of the pattern having a relatively short cycle. For example, as the pattern illustrated in FIG. 13, 12 dot, 20 dot, 24 dot, and 32 dot cycle patterns are configured at a dot ratio of 50%. In this case, if a pattern more affected by dot gain is a 12 dot cycle pattern, only a 12 dot cycle pattern is set to be n=5, m=7 to reduce a dot ratio thereof. By this, reduction of the reflectivity due to dot gain is compensated by an increased blank region, and the reflectivity of the section not completely filled with dots decreases to a reflection close to that of the section completely filled with dots affected by dot gain. As a result, an optical characteristic close to the solid line in FIG. 17 can be obtained.

As described above, change of an optical characteristic of a high cycle pattern due to dot gain can be brought close to an optical characteristic less affected by dot gain by adjusting the dot ratio. Selecting a dot ratio may be changed according to factors that affect dot gain, such as the repetition cycle of a pattern, the size of a dot, the printing resolution, the ink color, the wavelength characteristic of an LED and the type of printing medium. By offsetting the contribution of dot gain, without reducing change of the reflectivity relative to the amount of shift in the neighborhood of the maximum point of the optical reflectivity, improvement of the detection accuracy of the maximum point can be maintained.

Embodiment 3

In the present embodiment, a case where the above adjustment pattern is used to detect a landing position shift in a conveying direction will be described.

Figure 18:
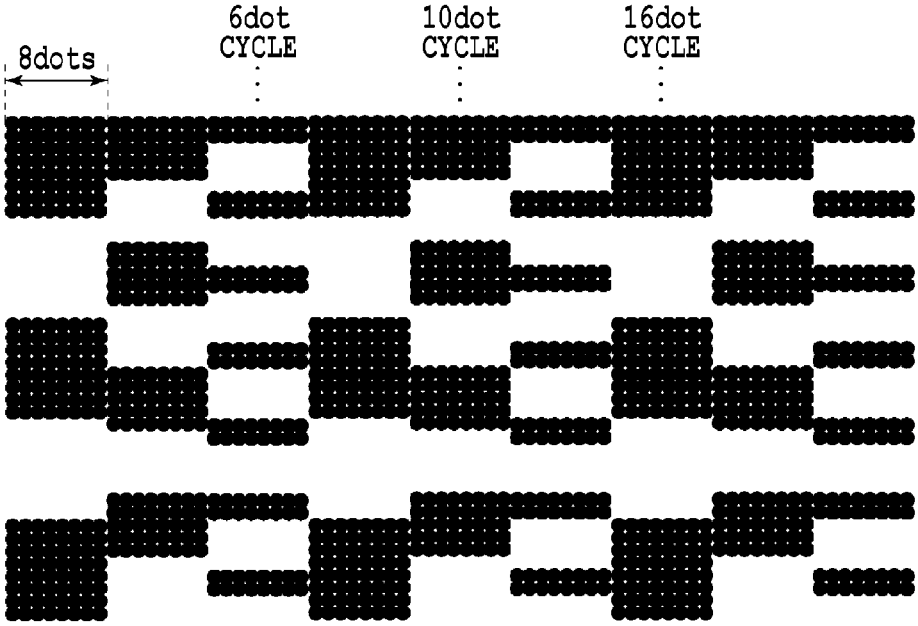
FIG. 18 is a diagram illustrating an adjustment pattern according to Embodiment 3.

FIG. 18 is one example of a pattern configuration for detecting a landing position shift between nozzle arrays in a conveying direction (a vertical scanning direction). In the present embodiment, the printing position of the shift pattern is moved relative to the reference pattern in a conveying direction, thereby obtaining an optical characteristic. Therefore, in order to arrange a plurality of cyclic patterns, the cycle of pattern is changed according to the position of the main scanning direction.

A pattern having a cycle different from the cycle of the pattern selected in the above scanning direction may be selected. If the maximum amount of shift between the two nozzle arrays in a conveying direction is smaller than the maximum amount of shift in a scanning direction, the range for changing the amount of shift of the pattern can be reduced. In this case, the repetition cycle of an optical characteristic may be shortened according to the range to which the amount of shift is applied, and accordingly the cycle of pattern can be shortened. In the example in FIG. 18, used are 6 dot, 10 dot and 16 dot cycle patterns that have cycles shorter than those of the adjustment pattern in Embodiments 1 and 2. On the contrary, if the landing position shift needs to be detected in a wider range, a pattern having a relatively long cycle is used to lengthen the repetition cycle of the optical characteristic.

As described above, also in the case where the landing position shift in a conveying direction is detected, by changing the direction of arrangement of the cyclic pattern, an adjustment pattern having the same optical characteristic as an optical characteristic obtained when the amount of shift in a scanning direction is detected can be formed.

Embodiment 4

In the present embodiment, a case where there is a landing position shift in both of the scanning direction and the conveying direction between two nozzle arrays and the landing position shift is detected by an adjustment pattern composed of the above plurality of cyclic patterns will be described.

Figure 19:
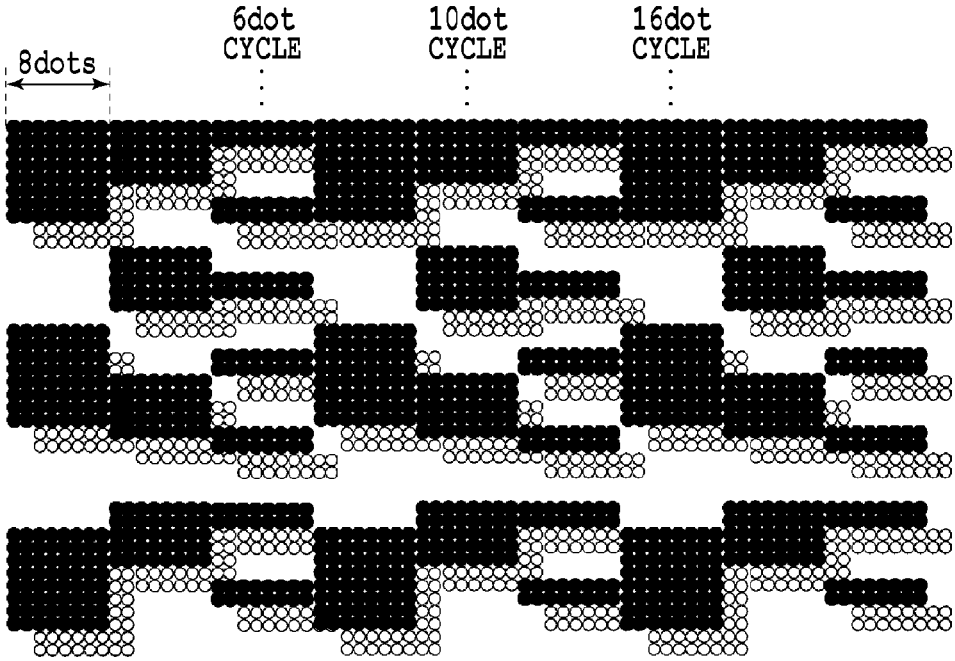
FIG. 19 is a diagram illustrating the adjustment pattern according to Embodiment 3 in which the landing of ink also is shifted in a scanning direction.

In the case where landing positions of two nozzle arrays shift relative to each other in both of a scanning direction and a conveying direction, attention is required for using the above plurality of cyclic patterns. For example, a case where while landing positions of two nozzle arrays shift relative to each other by +2 pixels in a scanning direction, a pattern for adjusting the landing position shift of two nozzle arrays in a conveying direction is printed will be studied. FIG. 19 illustrates, in such a pattern, a dot arrangement where the amount of landing position shift in a conveying direction is two pixels. Since shift pattern dots represented by white circles shift in not only a conveying direction but also a scanning direction relative to reference pattern dots represented by black dots, the same cyclic patterns are not printed at the same scanning positions. As a result, the optical reflectivity is different from the average of optical reflectivity values of the respective cyclic patterns and, therefore, the amount of shift for matching the reference pattern and the shift pattern cannot be accurately detected.

To prevent this problem, the landing position shift in a scanning direction between two nozzle arrays is previously detected where the amount of shift in a conveying direction is to be detected, and the landing position shift must be corrected before printing a pattern for detecting the shift in a conveying direction. Also in the case where the landing position shift in a scanning direction is detected, if there is a landing position shift in a conveying direction, the same measure is required. In this measure, first, the landing position shift in a direction perpendicular to the direction of the landing position shift to be detected is detected with the use of a single cycle pattern. The optical reflectivity of a single cycle pattern varies depending on only the landing position shift in a detected direction, as illustrated in FIG. 5. Even if the pattern shifts in a vertical direction, since overlapping dot patterns are the same, the optical reflectivity is hardly affected. Therefore, even if there is a landing position shift in both directions, the landing position shift can be detected at a certain level of accuracy. Then, the landing position shift in a direction perpendicular to the direction of the landing position shift to be detected is corrected by a registration adjustment, and after that, a plurality of cyclic patterns are used to print an adjustment pattern in a direction that requires a highly accurate detection.

As has been described, even if there is a landing position shift in both of the main scanning direction (a first direction) and the conveying direction (a second direction) that intersects with the main scanning direction, the landing position shift in the direction to be detected can be detected with the use of a plurality of cyclic patterns.

Other Embodiments

In the above description, a method to configure an adjustment pattern for detecting a landing position shift between two nozzle arrays in a scanning direction or a landing position shift in bidirectional printing has been described. However, the present invention is widely applicable as a pattern for detecting a position shift and is not limited by the arrangement of nozzle arrays, combination of ink colors and the configuration of a multi-sensor. The present invention is not limited to an inkjet printer, but can be applied to any printing apparatus that can form a pattern between two printing elements on a printing medium and measure an optical characteristic of the pattern. For example, the present invention can be applied to, for example, a laser printer.

When a nozzle position to print a reference pattern is different from the nozzle position to print a shift pattern, a printing medium may be conveyed between printing of the two patterns.

In Embodiment 1 and Embodiment 2, the reflectivity is measured by a sensor for each amount of shift, and the amount of shift realizing a maximum reflectivity is found based on the inflection point of an approximation curve and the correction amount of landing position shift is calculated. A correction amount can be selected by the user's eye. In this case, the amount of shift realizing a maximum reflectivity is determined by the user as the amount of optimal shift, and the correction value is inputted via the printing apparatus and a host computer.

In the above embodiments, exemplified were first and second patterns in which a dot region of a predetermined number of pixels and a blank region of a predetermined number of pixels are repeated. The present invention is not limited to this, but any pattern that has a repetition cyclic nature can be used.

In the above embodiments, described were a case in which while ink is being discharged by the same nozzle array, scanning is performed in outgoing and returning directions and while ink is being discharged by a different nozzle array, scanning is performed in the same scanning directions, thereby performing printing on the same target position. However, a first printing means and a second printing means of the present invention are not limited to this, but can be applied to a case in which while ink is being discharged from different nozzle arrays, a reciprocating scanning is performed.

In the above embodiments, a case in which a so-called serial-type inkjet printer is used was described, but the present invention can be applied to a so-called line-type inkjet printer.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2011-014313, filed Jan. 26, 2011, which is hereby incorporated by reference herein in its entirety.

What is claimed is:

1. A printing apparatus comprising:

a printing unit configured to print an image by printing dots on a printing medium;

a pattern printing unit configured to cause the printing unit to print a plurality of first patterns and a plurality of second patterns so as to form a plurality of third patterns on the printing medium, wherein each of the plurality of third patterns includes one of the second patterns being shifted relative to one of the first patterns in a predetermined direction, and each of the plurality of third patterns has optical reflection characteristics varying depending on the amount of shift between the first patterns and the second patterns; and an adjustment unit configured to perform an adjustment regarding positions of dots to be printed by the printing unit, according to an adjustment amount based on one of the third patterns printed on the printing medium, wherein the first and second patterns each include a plurality of different subpatterns in each of which a dot region for printing a predetermined number of dots and a blank region corresponding to the predetermined number of dots are periodically repeated in the predetermined direction in a repetition cycle, each of the plurality of subpatterns extending in the predetermined direction with the different subpatterns being arranged in a direction intersecting with the predetermined direction and having different repetition cycles in the predetermined direction.

2. The printing apparatus of claim 1, wherein a dot ratio in at least one subpattern having a relatively short repetition cycle among the plurality of subpatterns in the first and second patterns is set lower than a dot ratio in at least one subpattern having a relatively long repetition cycle among the plurality of subpatterns in the first and second patterns, the ratio being defined as a ratio of pixels between the dot and blank regions.

3. The printing apparatus of claim 2, wherein the printing unit discharges ink so as to print dots on the printing medium, and the pattern printing unit selects the dot ratio according to at least one of an amount of ink droplets, a color of ink droplets and a type of printing medium.

4. The printing apparatus of claim 1, wherein the printing unit includes a plurality of nozzle arrays arranged along the predetermined direction, the nozzle arrays ejecting ink so as to print dots on a printing medium, and each of the third patterns includes a pattern for detecting an amount of shift in the predetermined direction between the plurality of nozzle arrays.

5. The printing apparatus of claim 1, wherein an optical reflectivity of the plurality of third patterns takes a maximum or minimum value at a position where an amount of printing position shift of the printing unit and an amount of shift between the first pattern and the second pattern match.

6. The printing apparatus of claim 1, further comprising a measuring unit configured to measure optical reflectivities of the plurality of third patterns and the adjustment unit determines the adjustment amount based on the optical reflectivities of the plurality of third patterns measured by the measuring unit.

7. The printing apparatus of claim 6, wherein a measurement range by the measuring unit includes at least one cycle of each of the plurality of subpatterns.

8. The printing apparatus of claim 1, wherein the adjustment unit determines the adjustment amount based on the amount of shift between one of the first patterns and one of the second patterns in an adjustment pattern which is determined from a plurality of adjustment patterns based on user input.

9. The printing apparatus of claim 1, wherein the first patterns and the second patterns have the same form.

10. The printing apparatus of claim 1, wherein an image is printed on the printing medium by effecting relative scanning between the printing unit and the printing medium, each of the third patterns being a pattern for acquiring information on relative shift amount between the dot printing position scanned in the predetermined direction and the dot printing position scanned in the direction opposite to the predetermined direction, and the pattern printing unit causes the printing unit to print the first patterns by scanning in the predetermined direction and to print the second patterns by scanning in a direction opposite to the predetermined direction.

11. A printing position adjustment method for adjusting a printing position of an image to be printed by a printing unit of a printing apparatus, the method comprising:

causing the printing unit to print a plurality of first patterns and a plurality of second patterns so as to form a plurality of third patterns on a printing medium, wherein each of the plurality of third patterns includes one of the second patterns being shifted relative to one of the first patterns in a predetermined direction and each of the plurality of third patterns has optical reflection characteristics varying depending on the amount of shift between the first patterns and the second patterns; and performing an adjustment regarding positions of dots to be printed by the printing unit, according to an adjustment amount based on one of the third patterns printed on the printing medium, wherein the first and second patterns each include a plurality of different subpatterns in each of which a dot region for printing a predetermined number of dots and a blank region corresponding to the predetermined number of dots are periodically repeated in the predetermined direction in a repetition cycle, each of the plurality of subpatterns extending in the predetermined direction with the different subpatterns being arranged in a direction intersecting with the predetermined direction and having different repetition cycles in the predetermined direction.

* * * * *